US009243457B2

(12) United States Patent
Hu

(10) Patent No.: US 9,243,457 B2
(45) Date of Patent: Jan. 26, 2016

(54) UNDERREAMER FOR INCREASING A WELLBORE DIAMETER

(71) Applicant: Smith International, Inc., Houston, TX (US)

(72) Inventor: Jianbing Hu, Houston, TX (US)

(73) Assignee: Smith International, Inc., Houston, TX (US)

( * ) Notice: Subject to any disclaimer, the term of this patent is extended or adjusted under 35 U.S.C. 154(b) by 312 days.

(21) Appl. No.: 13/797,354

(22) Filed: Mar. 12, 2013

(65) Prior Publication Data

US 2014/0131108 A1 May 15, 2014

Related U.S. Application Data

(60) Provisional application No. 61/725,839, filed on Nov. 13, 2012.

(51) Int. Cl.
*E21B 10/32* (2006.01)

(52) U.S. Cl.
CPC ..... *E21B 10/322* (2013.01); *E21B 10/32* (2013.01)

(58) Field of Classification Search
CPC ..... E21B 10/26; E21B 10/32; E21B 10/322; E21B 10/325
See application file for complete search history.

(56) References Cited

U.S. PATENT DOCUMENTS

| | | | | |
|---|---|---|---|---|
| 6,732,817 | B2 | 5/2004 | Dewey et al. | |
| 2004/0222022 | A1 | 11/2004 | Nevlud et al. | |
| 2005/0241858 | A1 | 11/2005 | Eppink et al. | |
| 2006/0144623 | A1 | 7/2006 | Ollerensaw et al. | |
| 2010/0089583 | A1 * | 4/2010 | Xu et al. | 166/298 |
| 2012/0205157 | A1 | 8/2012 | Radford et al. | |

* cited by examiner

*Primary Examiner* — Brad Harcourt

(57) ABSTRACT

An underreamer for increasing a diameter of a wellbore. The underreamer includes a body having an axial bore extending at least partially therethrough. A sleeve is arranged and designed to move a first axial distance within the body. A cutter block is movably coupled to the body. The cutter block is arranged and designed to move at least the first axial distance with respect to the body to contact the sleeve in response to hydraulic pressure in the bore. The cutter block moves from a first outer diameter to a second outer diameter as the cutter block moves the first axial distance.

15 Claims, 4 Drawing Sheets

UNDERREAMER FOR INCREASING A WELLBORE DIAMETER

CROSS REFERENCE TO RELATED APPLICATIONS

This application claims the benefit of a related U.S. Provisional Application having Ser. No. 61/725,839 filed Nov. 13, 2012, entitled "Underreamer for Increasing a Wellbore Diameter," to Jianbing Hu, the disclosure of which is incorporated by reference herein in its entirety.

BACKGROUND

Embodiments described herein generally relate to downhole tools. More particularly, such embodiments relate to underreamers and stabilizers for enlarging the diameter of a wellbore.

After a wellbore is drilled, an underreamer is oftentimes used to enlarge the diameter of the wellbore. The underreamer is run into the wellbore in an inactive state. In the inactive state, cutter blocks on the underreamer are folded inwardly toward the body of the underreamer such that the cutter blocks are positioned radially-inward from the surrounding casing or wellbore wall. Once the underreamer reaches the desired depth in the wellbore, the underreamer is actuated to an active state. In the active state, the cutter blocks move radially-outward and into contact with the wellbore wall. The cutter blocks are then used to increase the diameter of the wellbore.

Conventional underreamers have cutter blocks with a fixed outer diameter when in the active state. As such, conventional underreamers are adapted to create a segment of the wellbore having an increased, but uniform, diameter. It is oftentimes desirable, however, for the wellbore to have varying diameters. For example, cutter blocks become worn down due to excessive vibration in the wellbore. Reducing the diameter of the cutter blocks tends to stabilize the downhole tool, thereby reducing or eliminating wear on the cutter blocks. Currently, this is achieved by pulling the underreamer out of the wellbore to the surface to adjust the outer diameter of the cutter blocks. This delay can lead to lost profits in the field.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

An underreamer for increasing a diameter of a wellbore is disclosed. The underreamer includes a body having an axial bore extending at least partially therethrough. A sleeve is arranged and designed to move a first axial distance within the body. A cutter block is movably coupled to the body. The cutter block is arranged and designed to move at least the first axial distance with respect to the body to contact the sleeve in response to hydraulic pressure in the bore. The cutter block moves from a first outer diameter to a second outer diameter as the cutter block moves the first axial distance.

In another embodiment, the underreamer includes a body having an axial bore extending at least partially therethrough. A recess is formed on an outer surface of the body. An actuator is disposed at least partially within the bore. An annular sleeve is coupled to the actuator. The sleeve includes a set of threads formed on an outer surface thereof that are engaged with a set of threads formed in an inner surface of the body. The actuator is adapted to rotate the sleeve with respect to the body, thereby moving the sleeve a first axial distance within the body. A cutter block is at least partially disposed in the recess and movably coupled to the body. The cutter block is arranged and designed to move at least the first axial distance with respect to the body to contact the sleeve in response to hydraulic pressure in the bore. The cutter block moves from a first outer diameter to a second outer diameter as the cutter block moves the first axial distance.

A method for increasing a diameter of a wellbore is also disclosed. The method includes operating an actuator to rotate an annular sleeve coupled to the actuator. The sleeve includes a set of threads formed on an outer surface thereof that is engaged with a set of threads formed in an inner surface of a body. The sleeve moves a first axial distance within the body in response to the rotation of the sleeve. The method further includes applying hydraulic force to move a cutter block coupled to the body at least the first axial distance with respect to the body to contact the sleeve. The cutter block moves radially outward from a first outer diameter to a second outer diameter as the cutter block moves the first axial distance. The cutter block increases the diameter of the wellbore to the second outer diameter.

BRIEF DESCRIPTION OF THE DRAWINGS

So that the recited features may be understood in detail, a more particular description, briefly summarized above, may be had by reference to one or more embodiments, some of which are illustrated in the appended drawings. It is to be noted, however, that the appended drawings illustrate only exemplary embodiments, and are, therefore, not to be considered limiting of its scope.

DETAILED DESCRIPTION

Figure 1:
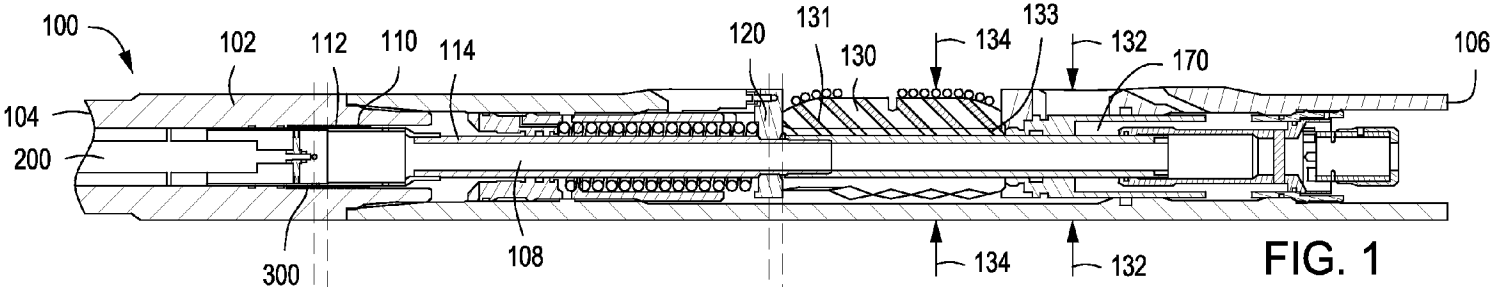
FIG. 1 depicts a cross-sectional view of an illustrative underreamer for increasing a diameter of a wellbore, according to one or more embodiments disclosed.
Figure 2:
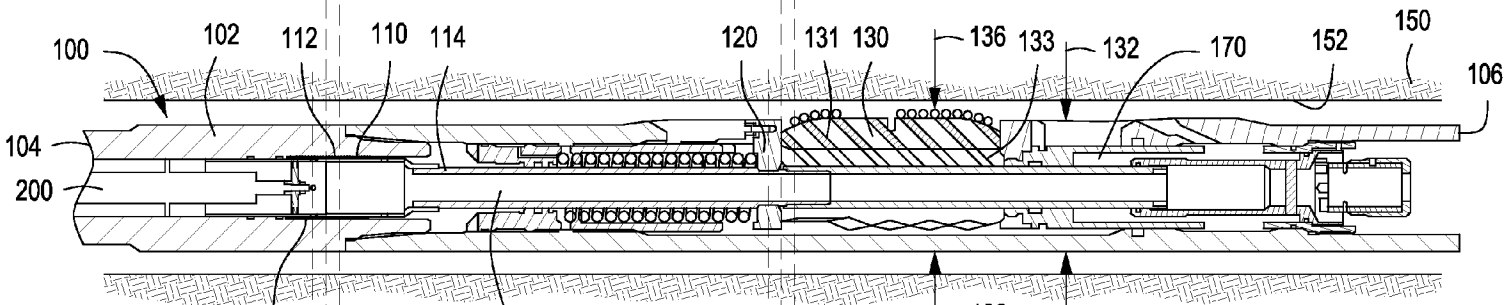
FIG. 2 depicts a cross-sectional view of the underreamer having the cutter block positioned at a second diameter, according to one or more embodiments disclosed.
Figure 3:
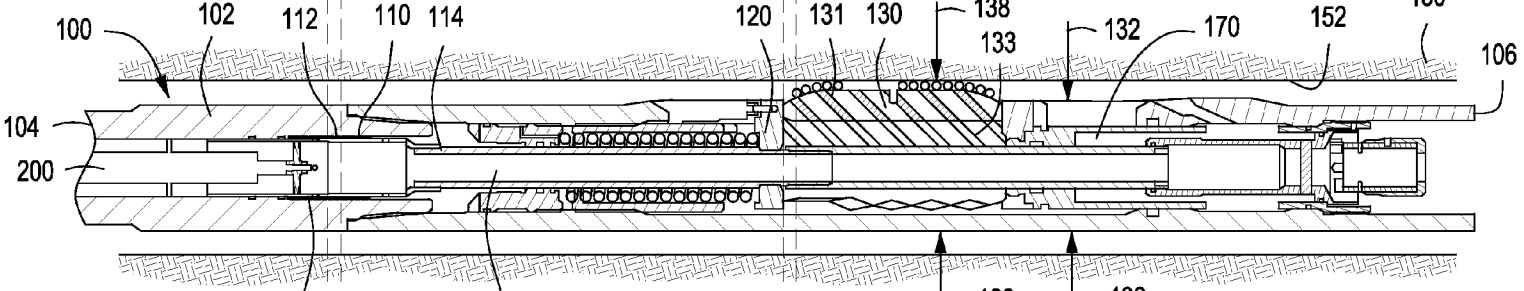
FIG. 3 depicts a cross-sectional view of the underreamer having the cutter block positioned at a third diameter, according to one or more embodiments disclosed.

FIGS. 1-3 depict cross-sectional views of an illustrative underreamer 100 for increasing a diameter of a wellbore 150, according to one or more embodiments. The underreamer 100 includes a body 102 having a first or "upper" end portion 104 and a second or "lower" end portion 106. An axial bore 108 extends partially or completely through the body 102.

In at least one embodiment, an actuator 200 may be disposed within the bore 108 of the body 102. The actuator 200 may be a motor, such as an electric motor ("electromotor"), a hydraulic motor, or any other device adapted to move one or more components axially and/or rotationally within the bore 108 of the body 102. An annular sleeve 300 is disposed within the body 102 and coupled to the actuator 200. The actuator 200 is arranged and designed to move the sleeve 300 axially within the body 102 toward the first end portion 104 of the body 102 and/or toward the second end portion 106 of the body 102. The interaction between the actuator 200 and the sleeve 300 is described in more detail below with respect to FIGS. 4-6. Alternatively, actuator 200 may be a linear-type actuator arranged and designed to move annular sleeve 300 axially within or relative to body 102.

As readily known to those skill in the art, actuator 200 may have a control unit (not shown) coupled thereto or integral therewith. The control unit is adapted to control the movement of the actuator 200 in response to a signal received from the surface. Such signal may be or include a mud pulse signal, an electromagnetic signal, an electric signal, a hard wire magnetic signal, an acoustic signal, a pressure signal, or the like. The actuator 200 may also have a power source, e.g., a battery, coupled thereto to power its operation. Such power source may also couple to the control unit to provide power to receive/transmit signals from/to the surface and/or send operational commands to the actuator 200.

An annular sleeve extension 110 may be disposed within the body 102 and axially adjacent to the sleeve 300. In at least one embodiment, the sleeve extension 110 is coupled to and/or integral with the sleeve 300. The sleeve extension 110 may be a single component, or the sleeve extension 110 may include two or more components. As shown, the sleeve extension 110 includes a first or "outer" sleeve extension 112 coupled to a second or "inner" sleeve extension 114.

When the sleeve 300 is moved by the actuator 200, the sleeve 300 moves the sleeve extension 110 axially within the body 102 toward the first end portion 104 of the body 102 and/or toward the second end portion 106 of the body 102. The sleeve 300 may also limit the axial movement of the sleeve extension 110 in a direction toward the first end portion 104 of the body 102. In other words, the sleeve extension 110 (i.e., if decoupled from the sleeve 300) may move toward the first end portion 104 of the body 102 until it contacts the sleeve 300, at which point further movement toward the first end portion 104 of the body 102 is prevented.

One or more stoppers (one is shown 120) may be coupled to the sleeve extension 110 and extend radially outward therefrom. The stopper 120 may be a single component, or the stopper 120 may include two or more components that are circumferentially offset from one another. The stopper 120 is adapted to move with the sleeve extension 110. Thus, when the sleeve extension 110 is moved by the sleeve 300, the sleeve extension 110 and the stopper 120 move axially within the body 102 toward the first end portion 104 of the body 102 and/or toward the second end portion 106 of the body 102.

One or more cutter blocks (one is shown 130) is at least partially disposed in a recess in the outer surface of the body 102. The cutter block 130 is movably coupled to the body 102 proximate the stopper 120. Although a single cutter block 130 is seen in FIG. 1, one or more additional cutter blocks may be circumferentially offset around the body 102. For example, the number of cutter blocks 130 may range from a low of 1, 2, 3, or 4 to a high of 6, 8, 10, 12, or more. The cutter block 130 may be disposed between the stopper 120 and the second end portion 106 of the body 102, as shown.

The cutter block 130 shown in FIG. 1 is in an inactive state. In the inactive state, the outer diameter of the cutter block 130 ("first diameter 134") is the same as, substantially the same as, or less than the outer diameter 132 of the body 102, and the cutter block 130 may be spaced apart from the surrounding casing (not shown) and/or wall 152 of the wellbore 150 (see FIGS. 2 and 3). An illustrative underreamer 100 having a cutter block 130 movably coupled thereto is shown and described in U.S. Pat. No. 6,732,817, filed Feb. 19, 2002, entitled "Expandable Underreamer/Stabilizer," to Dewey et al., the content of which is incorporated by reference to the extent consistent with the present disclosure.

FIG. 2 depicts the underreamer 100 having the cutter block 130 positioned at a second diameter 136, and FIG. 3 depicts the underreamer 100 having the cutter block 130 positioned at a third diameter 138, according to one or more embodiments. Referring now to FIGS. 1-3, the second diameter 136 is shown as being greater than the first diameter 134, and the third diameter 138 is shown as being greater than the second diameter 136.

As explained in more detail below, an axial force is exerted on the cutter block 130 to move it toward the first end portion 104 of the body 102. The axial movement of the cutter block 130, however, is limited by contact with the stopper 120. In other words, the cutter block 130 moves axially toward the first end portion 104 of the body 102 until it contacts the stopper 120, at which point further axial movement is prevented.

The cutter block 130 may have a plurality of splines 131 disposed or formed on one or more outer side surfaces thereof. The splines 131 on the cutter block 130 may be or include offset ridges or protrusions adapted to engage and slide within corresponding grooves 133 in the body 102 of the underreamer 100. The splines 131 on the cutter block 130 are oriented at an angle with respect to the longitudinal axis through the body 102 of the underreamer 100. The angle of the splines 131 on the cutter block 130 (and the corresponding grooves 133 in the body 102) may range from a low of about 10°, about 15°, about 20°, or about 25° to a high of about 30°, about 40°, about 50°, about 60°, or more. For example, the angle may be between about 15° and about 25° with respect to the longitudinal axis through the body 102.

When an axial force is exerted on the cutter block 130 in a direction toward the first end portion 104 of the body 102, the engagement of the splines 131 on the cutter block 130 and the grooves 133 in the body 102 causes the cutter block 130 to simultaneously move axially toward the first end portion 104 of the body 102 and radially outward (e.g., between about 15° and about 25° with respect to the longitudinal axis through the body 102). Thus, when the cutter block 130 moves a first axial distance 140 toward the first end portion 104 of the body 102, it moves radially outward from the first diameter 134 (FIG. 1) to the second diameter 136 (FIG. 2). In at least one embodiment, when the cutter block 130 is positioned at the second diameter 136, it may be in contact with the wall 152 of the wellbore 150 and adapted to increase the diameter of the wellbore 150 to the second diameter 136.

When the cutter block 130 moves a second axial distance 142 toward the first end portion 104 of the body 102, it moves radially outward from the second diameter 136 (FIG. 2) to the third diameter 138 (FIG. 3). In at least one embodiment, when the cutter block 130 is positioned at the third diameter 138, it may be in contact with the wall 152 of the wellbore 150 and adapted to increase the diameter of the wellbore 150 to the third diameter 138. Accordingly, when the cutter block 130 is positioned at the second and/or third diameters 136, 138, it may be referred to as being in the "active" state.

The first distance 140 may be the same as the second distance 142, or it may be different. Although three axial positions (and three corresponding diameters 134, 136, 138) of the cutter block 130 are shown, it may be appreciated that the diameters are exemplary, and the cutter block 130 may be set at any diameter between a minimum diameter (e.g., the first diameter 134) and a maximum diameter (e.g., the third diameter 138).

Figure 4:
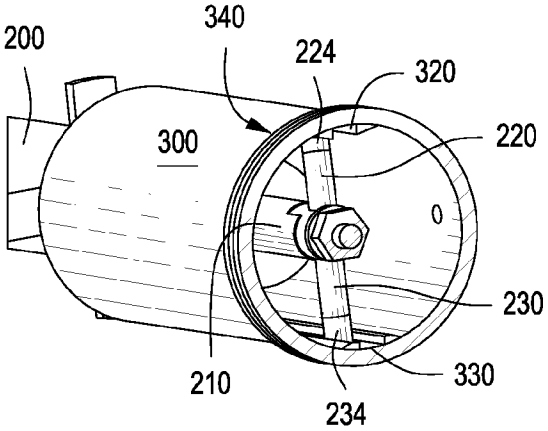
FIG. 4 depicts a perspective view of the motor and the sleeve of the underreamer, according to one or more embodiments disclosed.
Figure 5:
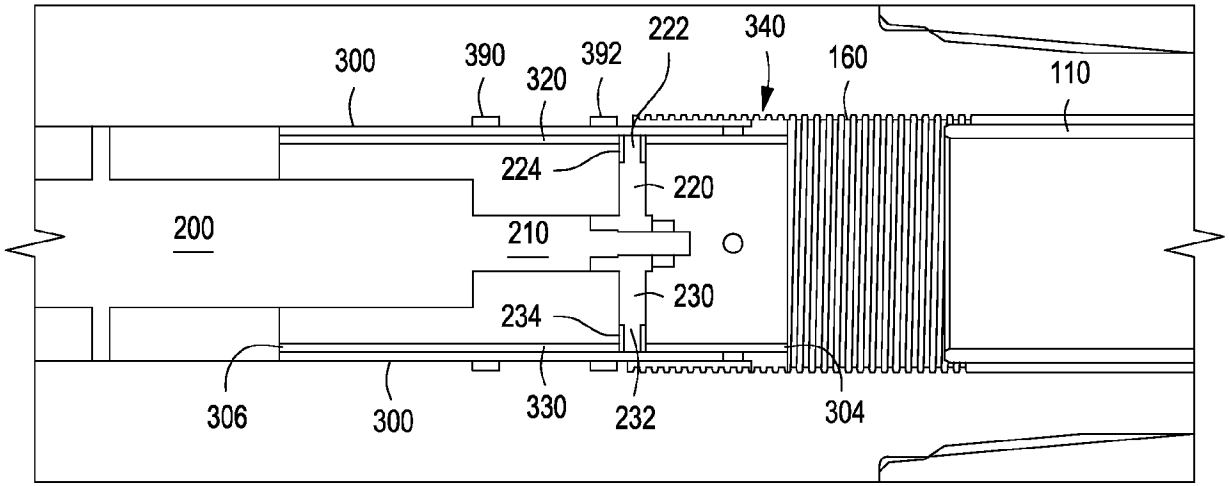
FIG. 5 depicts a cross-sectional view of the motor and the sleeve of the underreamer, according to one or more embodiments disclosed.

FIG. 4 depicts a perspective view of the actuator 200 and the sleeve 300 of the underreamer 100 (FIGS. 1-3), and FIG. 5 depicts a cross-sectional view of the actuator 200 and the sleeve 300 of the underreamer 100, according to one or more embodiments. In at least one embodiment, the actuator 200 may include an arm 210 that is coupled to the sleeve 300 and disposed at least partially within the sleeve 300. The arm 210 is adapted to be rotated by the actuator 200 about a longitudinal axis extending through the arm 210. The longitudinal axis extending through the arm 210 may be parallel and/or aligned with the longitudinal axis extending through the body 102. The arm 210 rotates but does not move axially. In at least one embodiment, however, an actuator 200 (e.g., a linear actuator) may move the sleeve 300 axially without rotating the sleeve 300.

One or more pins or rods 220, 230 may extend radially outward from the arm 210. As shown, two rods 220, 230 may be coupled to the arm 210 and extend radially outward therefrom. In another embodiment, a single rod (not shown) may extend through the arm 210 and radially outward in opposing directions. The end portions 222, 232 of the rods 220, 230 distal the arm 210 may be disposed within corresponding axial tracks on or grooves 320, 330 in the inner surface of the sleeve 300.

Figure 6:
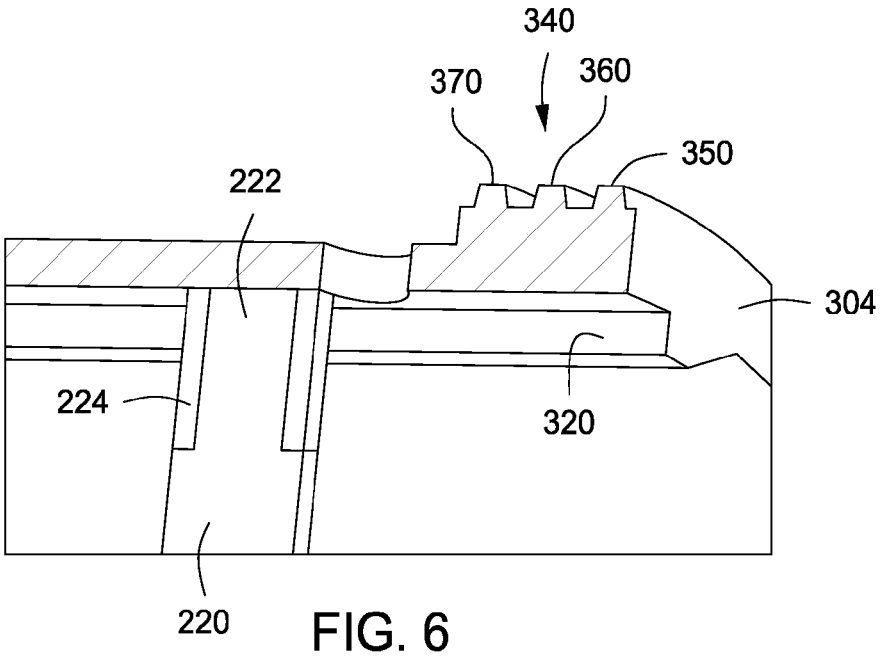
FIG. 6 depicts a partial cross-sectional view of the rod disposed within a groove of the sleeve, according to one or more embodiments disclosed.

FIG. 6 depicts a partial cross-sectional view of the rod 220 disposed within the groove 320 of the sleeve 300, according to one or more embodiments. Referring now to FIGS. 4-6, the sleeve 300 may have a set of threads 340 formed on an outer surface thereof. The threads 340 may be formed proximate a first axial end portion 304 of the sleeve 300 (as shown), a second axial end portion 306 of the sleeve 300 (opposite the first axial end portion 304 but not shown), or anywhere therebetween. The threads 340 may be formed helically around the outer surface of the sleeve 300. The threads 340 on the outer surface of the sleeve 300 are engaged with corresponding threads 160 formed in the inner surface of the body 102. The threads 340 on the outer surface of the sleeve 300 may be male or pin threads, and the threads 160 in the inner surface of the body 102 may be female or box threads, or vice versa.

Returning to FIG. 5, when the arm 210 of the actuator 200 rotates in a first direction, the rods 220, 230 also rotate in the first direction. The interaction between the rods 220, 230 and the grooves 320, 330 causes the sleeve 300 to rotate in the first direction. Thus, the arm 210, the rods, 220, 230, and the sleeve 300 rotate together in the same direction and at the same rate. As the sleeve 300 rotates in the first direction, the interaction between the threads 340 on the sleeve 300 and the threads 160 in the body 102 convert the rotational movement of the sleeve 300 to axial movement in a first direction (e.g., toward the first end portion 104 of the body 102) with respect to the arm 210 and the rods 220, 230 (and body 102). The arm 210 and the rods 220, 230 may remain axially stationary with respect to the body 102.

When the arm 210 of the actuator 200 rotates in a second direction, the rods 220, 230 also rotate in the second direction. The interaction between the rods 220, 230 and the grooves 320, 330 causes the sleeve 300 to rotate in the second direction. As the sleeve 300 rotates in the second direction, the interaction between the threads 340 on the sleeve 300 and the threads 160 in the body 102 converts the rotational movement of the sleeve 300 to axial movement in a second direction (e.g., toward the second end portion 106 of the body 102) with respect to the arm 210 and the rods 220, 230 (and body 102). The arm 210 and the rods 220, 230 may remain axially stationary with respect to the body 102.

As the sleeve 300 moves axially in the first and/or second direction, the rods 220, 230 (axially stationary) slide or transition through the grooves 320, 330 in the sleeve 300. In at least one embodiment, the end portions 222, 232 of the rods 220, 230 may have bearings 224, 234 (FIG. 5) disposed thereon or thereabout to reduce friction as the rods 220, 230 transition through the grooves 320, 330 as the sleeve 300 moves axially with respect to the rods 220, 230. The bearings 224, 234 may be or include a bearing jacket, a bushing, a needle bearing, or the like. One or more bearings 390, 392 may also be disposed around the outer surface of the sleeve 300 to reduce friction as the sleeve 300 moves with respect to the body 102.

Figure 7:
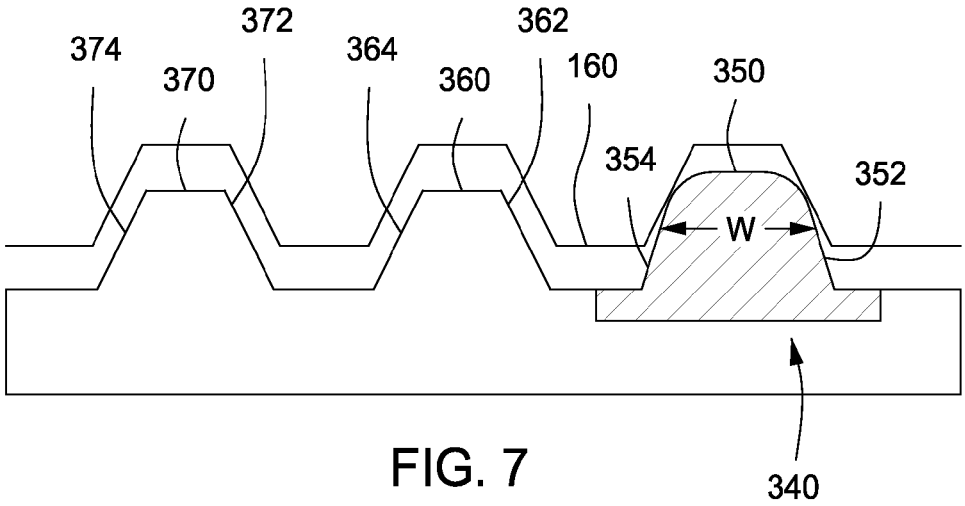
FIG. 7 depicts a cross-sectional view of illustrative threads on the sleeve disposed within the threads in the body when there is minimal or no axial force acting on the sleeve via the cutter block and the sleeve extension, according to one or more embodiments disclosed.

FIG. 7 depicts a cross-sectional view of illustrative threads 340 on the sleeve 300 (FIG. 5) disposed within the threads 160 in the body 102 (FIG. 5) when there is minimal or no axial force acting on the sleeve 300 via the cutter block 130 and/or the sleeve extension 110, according to one or more embodiments. The cross-section of threads 340 on the sleeve 300 may be or include one or more portions (three are shown 350, 360, 370). As shown, each portion 350, 360, 370 of the threads 340 may extend helically around the outer surface of the sleeve 300 about one revolution (360°). In other embodiments, each portion 350, 360, 370 of the threads 340 may extend helically around the outer surface of the sleeve 300 from a low of about 15°, about 30°, about 45°, about 60°, or about 90° to a high of about 180°, about 270°, about 360°, about 720°, about 1080°, or more. Although three portions 350, 360, 370 are shown, it may be appreciated that the number of portions may range from a low of 1, 2, 3, or 4 to a high of 6, 8, 10, 12, or more.

When there is minimal or no axial force acting on the sleeve 300 via the cutter block 130 and/or the sleeve extension 110, the sleeve 300 may be rotated with respect to the body 102. To facilitate rotation of the sleeve 300 within the body 102, at least one of the portions 350, 360, 370 may have a greater cross-sectional width "W" than the remaining portions 350, 360, 370. As shown, the first or "leading" portion 350, which is the portion nearest the first end portion 304 of the sleeve 300, has a greater cross-sectional width W than the remaining portions 360, 370. As a result, when the threads 340 on the sleeve 300 rotate with respect to the threads 160 in the body 102, the portion with the greater width W (e.g., the first portion 350) may be in contact with its corresponding portion of threads 160 in the body 102, while the remaining portions 360, 370 may be spaced apart from their corresponding portions of the threads 160 in the body 102. More particularly, the first and second axial faces 352, 354 of the portion with the greater width W (e.g., the first portion 350) are in contact with their corresponding portions of the threads 160 in the body, while the first and second faces 362, 364 of the second portion 360 are spaced apart from their corresponding portions of the threads 160 in the body 102, and the first and second faces 372, 374 of the third portion 370 are spaced apart from their corresponding portions of the threads 160 in the body 102. Limiting the number of portions 350, 360, 370 in contact with the corresponding portions of threads 160 in the body 102 may reduce the force to rotate the sleeve 300 with respect to the body 102.

The first face 352 and/or the second face 354 of the portion with the greater width W (e.g., the first portion 350) may be curved to reduce the surface area that is in contact with corresponding portions of the threads 160 in the body 102. This may further reduce the force to rotate the sleeve 300 with respect to the body 102.

Figure 8:
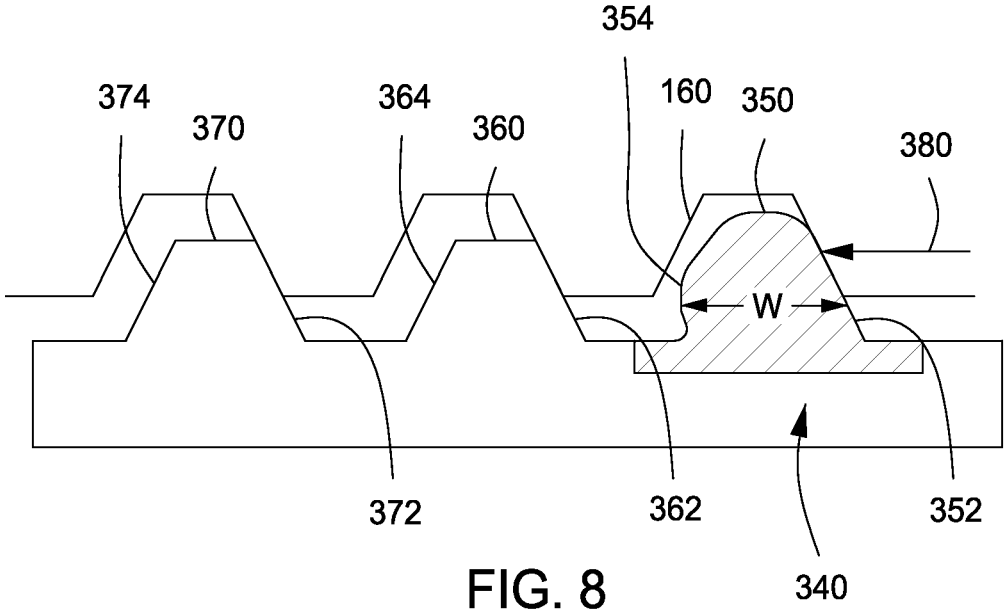
FIG. 8 depicts the threads on the sleeve disposed within the threads in the body when an axial force is acting on the sleeve via the cutter block and the sleeve extension, according to one or more embodiments disclosed.

FIG. 8 depicts threads 340 on the sleeve 300 disposed within the threads 160 in the body 102 when an axial force is acting on the sleeve 300 (e.g., toward the first end portion 104 of the body 102) via the cutter block 130 and/or the sleeve extension 110, according to one or more embodiments. The threads 340 may be made from metal, such as steel or stainless steel. In at least one embodiment, the portion with the greater width W (e.g., the first portion 350) may be made from a different material than the remaining portions 360, 370. For example, the first portion 350 may be made of a material that deforms at a lesser force than the remaining portions 360, 370. For example, the first portion 350 may be made of a polymer, an elastomer, or the like. In another embodiment, the first portion 350 may be a deformable pin, a guide pin, a screw, or the like, or the first portion 350 may be a pin, a screw, or a ball driven or supported by a spring or other elastic element.

As such, when an axial force acts on the sleeve 300 via the cutter block 130 and/or the sleeve extension 110, the first portion 350 may deform, thereby allowing the remaining portions 360, 370 to contact their corresponding portions of the threads 160 in the body 102. More particularly, the first face 362 of the second portion 360, and the first face 372 of the third portion 370 may contact their corresponding portions of the threads 160 in the body 102 when an axial force acts on the sleeve 300 via the cutter block 130 and/or the sleeve extension 110 in a direction toward the first end portion 104 of the body 102 (depicted with arrow 380). The remaining portions 360, 370 may be adapted to withstand the axial force applied via the cutter block 130 and/or the sleeve extension 110.

Figure 9:
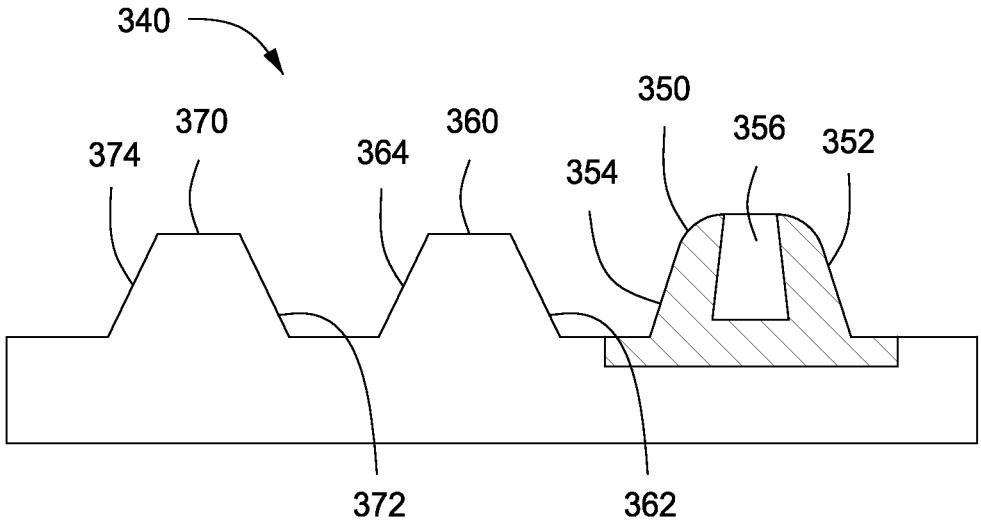
FIG. 9 depicts an illustrative portion of the threads on the sleeve having a void disposed therein, according to one or more embodiments disclosed.

FIG. 9 depicts an illustrative portion 350 on the sleeve 300 having a void disposed therein, according to one or more embodiments. In at least one embodiment, the portion with the greater width W (e.g., the first portion 350) may have a piece removed therefrom, leaving a void 356 disposed therein. The void 356 may enable the first portion 350 to deform when exposed to the force from the cutter block 130 and/or the sleeve extension 110.

Referring to FIGS. 1-9, in operation, the underreamer 100 is run into the wellbore 150 while the cutter block 130 is in the inactive state at the first diameter 134 (FIG. 1). The cutter block 130 is maintained at the first diameter 134 by contact with the stopper 120, which is coupled to the sleeve extension 110. More particularly, the stopper 120 prevents the cutter block 130 from moving axially toward the first end portion 104 of the body 102, which thereby prevents the cutter block 130 from moving radially outward. The sleeve 300 prevents the sleeve extension 110 (and the stopper 120) from moving axially toward the first end portion 104 of the body 102. In this position, stopper 120, sleeve extension 110, sleeve 300 and actuator 200 act as a lock to maintain the cutter block 130 in its retracted or inactive state.

To actuate or adjust the cutter block 130 of the underreamer 100 from the first diameter 134, as shown in FIG. 1, to the second diameter 136, as shown in FIG. 2, the actuator 200 rotates the arm 210 in a first direction. The rotation of the arm 210 and the rods 220, 230 coupled thereto causes the sleeve 300 to rotate in the first direction. As the sleeve 300 rotates in the first direction, the interaction between the threads 340 of the sleeve 300 and the threads 160 of the body 102 causes the sleeve 300 to move axially toward the first end portion 104 of the body 102 a first distance 140. If the sleeve 300 and sleeve extension 110 are decoupled, then movement of the sleeve 300 by the first distance 140 (or any subsequent distance) axially separates the sleeve 300 from the sleeve extension 110. In one embodiment, the interaction between the portion with the greater width W (e.g., the first portion 350) and the corresponding portion of threads 160 on the body 102 causes the sleeve 300 to move axially toward the first end portion 104 of the body 102 the first distance 140.

Fluid pressure is applied to the bore 108 from the surface, e.g., by pumping mud/drilling fluid downhole to bore 108. Sufficient pressure in the bore 108 causes a chamber 170 disposed between the cutter block 130 and the second end portion 106 of the body 102 to become pressurized (e.g., by opening a port or valve therebetween). The pressurized chamber 170 exerts a hydraulic force on the cutter block 130 in a direction toward the first end portion 104 of the body 102. The force moves the cutter block 130 axially toward the first end portion 104 of the body 102. Through the continued contact between the cutter block 130 and the stopper 120 (e.g., via a spring biasing such continued contact prior to cutter block 130 movement), the movement of the cutter block 130 also moves the stopper 120 and the sleeve extension 110 toward the first end portion 104 of the body 102 the first distance 140. Thus, the cutter block 130, the stopper 120, and the sleeve extension 110 move toward the first end portion 104 of the body 102 the first distance 140 until the sleeve extension 110 contacts the sleeve 300, at which point further axial movement of the cutter block 130, the stopper 120, and the sleeve extension 110 is prevented.

Alternatively, as will be readily understood by those skilled in the art, if the sleeve 300 and the sleeve extension 110 are coupled, then movement of the sleeve 300 via the actuator 200 by the first distance 140 (or any subsequent distance) axially separates the stopper 120 from the cutter block 130. In such embodiment, stopper 120 would not need or necessarily desire a biasing device, e.g., a spring, to maintain contact between stopper 120 and cutter block 130. Subsequent movement of the cutter block 130 toward the first end portion 104 of body 102 continues until contact is reestablished between the stopper 120 and cutter block 130.

The cutter block 130 moves radially outward from the first diameter 134 to the second diameter 136, simultaneously with its axial movement toward the first end portion 104 of the body 102, due to the engagement of the splines 131 and the corresponding grooves 133. When the axial movement is prevented after moving the first distance 140, further radial movement is also prevented, and the cutter block 130 is set at the second diameter 136, as shown in FIG. 2. Pressure may continue to be applied to the chamber 170 via the bore 108 to maintain the cutter block 130 at the second diameter 136. When the cutter block 130 is at the second diameter 136, it is in the active state and may cut or grind the wall 152 of the wellbore 150 to increase the diameter of a portion of the wellbore 150 to the second diameter 136.

The axial distance that the sleeve 300, the sleeve extension 110, and the cutter block 130 move with respect to the body 102 may correspond to the number of times that the actuator 200 rotates the sleeve 300. For example, the first distance 140 (and second distance 142) may correspond to five (5) rotations or revolutions of the sleeve 300 but may be any number of rotations or revolutions which equate to the desired first distance 140 (or second distance 142). The radial distance that the cutter block 130 moves with respect to the body 102 (e.g., from the first diameter 134 to the second diameter 136) corresponds to the axial distance (e.g., first distance 140) that the cutter block 130 moves with respect to the body 102. Thus, the cutting diameter of the cutter block 130 may be determined by the number of times the actuator 200 rotates the sleeve 300.

To actuate or adjust the cutter block 130 of the underreamer 100 from the second diameter 136, as shown in FIG. 2, to the third diameter 138, as shown in FIG. 3, the pressure in the bore 108 and the chamber 170 may be reduced, which thereby reduces the hydraulic force exerted on the cutter block 130 toward the first end portion 104 of the body 102. The arm 210 of the actuator 200 may then rotate again in the first direction. The rotation of the arm 210 and the rods 220, 230 coupled thereto causes the sleeve 300 to rotate in the first direction. As the sleeve 300 rotates in the first direction, the interaction between the threads 340 of the sleeve 300 and the threads 160 of the body 102 causes the sleeve 300 to move axially toward the first end portion 104 of the body 102 a second distance 142. In one embodiment, the interaction between the portion with the greater width W (e.g., the first portion 350) and the corresponding portion of the threads 160 on the body 102 causes the sleeve 300 to move axially toward the first end portion 104 of the body 102 the second distance 142.

Pressure is again applied to the bore 108 from the surface. The pressure in the bore 108 causes the chamber 170 to become pressurized. The pressurized chamber 170 exerts a hydraulic force on the cutter block 130 in a direction toward the first end portion 104 of the body 102. The force moves the cutter block 130 toward the first end portion 104 of the body 102. Through the continued contact between the cutter block 130 and the stopper 120, the movement of the cutter block 130 also moves the stopper 120 and the sleeve extension 110 toward the first end portion 104 of the body 102. The cutter block 130, the stopper 120, and the sleeve extension 110 move toward the first end portion 104 of the body 102 the second distance 142 until the sleeve extension 110 contacts the sleeve 300, at which point further axial movement of the cutter block 130, the stopper 120, and the sleeve extension 110 is prevented. Alternatively, if the sleeve 300 and the sleeve extension 110 are coupled, then as similarly disclosed above with respect to the first distance 140, the cutter block 130 will be permitted to move the second distance 142 into contact with the stopper 120.

The cutter block 130 moves radially outward from the second diameter 136 to the third diameter 138, simultaneously with its axial movement toward the first end portion 104 of the body 102, due to the engagement of the splines 131 and the grooves 133. When the axial movement is prevented after moving the second distance 142, further radial movement is also prevented, and the cutter block 130 is set at the third diameter 138, as shown in FIG. 3. Pressure may continue to be applied to the chamber 170 via the bore 108 to maintain the cutter block 130 at the third diameter 138. When the cutter block 130 is at the third diameter 138, it is in the active state and may cut or grind the wall 152 of the wellbore 150 to increase the diameter of a portion of the wellbore 150 to the third diameter 138.

To actuate or adjust the cutter block 130 of the underreamer 100 from the third diameter 138, as shown in FIG. 3, to the first diameter 134, as shown in FIG. 1, the pressure in the bore 108 and the chamber 170 is reduced, which thereby reduces the force exerted on the cutter block 130 toward the first end portion 104 of the body 102. The arm 210 of the actuator 200 may then rotate in the second direction. The rotation of the arm 210 and the rods 220, 230 coupled thereto causes the sleeve 300 to rotate in the second direction. As the sleeve 300 rotates in the second direction, the interaction between the threads 340 of the sleeve 300 and the threads 160 of the body 102 causes the sleeve 300 to move axially toward the second end portion 106 of the body 102 the sum of the first and second distances 140, 142. In one embodiment, the interaction between the portion with the greater width W (e.g., the first portion 350) and the corresponding portion of the threads 160 on the body 102 causes the sleeve 300 to move axially toward the second end portion 106 of the body 102.

As the sleeve 300 moves toward the second end portion 106 of the body 102, the sleeve 300 may be in contact with the sleeve extension 110 and thus move the sleeve extension 110 toward the second end portion 106 of the body 102 the sum of the first and second distances 140, 142. As the sleeve extension 110 moves toward the second end portion 106 of the body 102, the stopper 120 (which is coupled to the sleeve extension 110) is in contact with the cutter block 130 (e.g., via a biasing device or spring) and thus moves the cutter block 130 toward the second end portion 106 of the body 102 the sum of the first and second distances 140, 142. As the cutter block 130 moves axially toward the second end portion 106 of the body 102 the second distance 142, the cutter block 130 moves radially inward from the third diameter 138 to the second diameter 136, and as the cutter block 130 moves toward the second end portion 106 of the body 102 the first distance 140, the cutter block moves radially inward from the second diameter 136 to the first diameter 134, i.e., into the inactive state. Alternatively, if the sleeve 300 and the sleeve extension 110 are decoupled, the actuator 200 may not need to be rotated in the second direction to retract the cutter block 130 to its inactive state. By reducing pressure in chamber 170, the biasing device, e.g., spring, exerting force on stopper 120 (coupled to the sleeve extension 110) in the second direction may act to move stopper 120 and cutter block 130 into the inactive state. Such operation may be advantageous when it is desired to temporarily return the cutter block 130 to its inactive state while maintaining the desired cutting diameter of cutter block 130 upon the reapplication of sufficient fluid pressure in chamber 170.

An operator may diagnose a blockage or clogging of the cutter block 130 by attempting to move or rotate the actuator 200 while the pressure is being applied to the bore 108 and the chamber 170. For example, if the actuator 200 is able to move or rotate the sleeve 300 while the pressure is being applied to the bore 108 and the chamber 170, either the sleeve extension 110 is not in contact with the sleeve 300, or the cutter block 130 is not in contact with the stopper 120 of the sleeve extension 110. This may indicate or signal that the cutter block 130 is not fully actuated or deployed. However, if the actuator 200 is unable to rotate the sleeve 300 (due to an axial force acting on the sleeve 300) while the pressure is being applied to the bore 108 and the chamber 170, then this may indicate or signal that the cutter block 130 is fully actuated or deployed.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

Although only a few example embodiments have been described in detail above, those skilled in the art will readily appreciate that many modifications are possible in the example embodiments without materially departing from "Underreamer for Increasing a Wellbore Diameter." Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. An underreamer for increasing a diameter of a wellbore, comprising:

a body having an axial bore extending at least partially therethrough;

a sleeve arranged and designed to move a first axial distance within the body;

an actuator within the bore and coupled to the sleeve, the actuator arranged and designed to move the sleeve the first axial distance; and a cutter block movably coupled to the body, wherein the cutter block is arranged and designed to move at least the first axial distance with respect to the body in response to hydraulic pressure in the bore, and wherein the cutter block moves from a first outer diameter to a second outer diameter as the cutter block moves the first axial distance, wherein the actuator comprises an arm having a rod extending radially outward therefrom, wherein a longitudinal axis extending through the arm is parallel to a longitudinal axis extending through the body.

2. The underreamer of claim 1, wherein the sleeve has an axial groove formed in an inner surface thereof, and wherein an end portion of the rod is disposed within the groove.

3. The underreamer of claim 2, wherein the end portion of the rod transitions axially through the groove as the sleeve moves the first axial distance.

4. An underreamer for increasing a diameter of a wellbore, comprising:

a body having an axial bore extending at least partially therethrough;

a sleeve arranged and designed to move a first axial distance within the body; and a cutter block movably coupled to the body, wherein the cutter block is arranged and designed to move at least the first axial distance with respect to the body in response to hydraulic pressure in the bore, and wherein the cutter block moves from a first outer diameter to a second outer diameter as the cutter block moves the first axial distance wherein the sleeve comprises a set of threads formed on an outer surface thereof adapted to engage a set of threads formed on an inner surface of the body.

5. The underreamer of claim 4, wherein the threads formed on the outer surface of the sleeve include first and second portions, and wherein the first portion has a greater cross-sectional width than the second portion.

6. An underreamer for increasing a diameter of a wellbore, comprising:

a body having an axial bore extending at least partially therethrough, wherein a recess is formed on an outer surface of the body;

an actuator disposed at least partially within the bore;

an annular sleeve coupled to the actuator, wherein the sleeve includes a set of threads formed on an outer surface thereof that is engaged with a set of threads formed in an inner surface of the body, and wherein the actuator is adapted to rotate the sleeve with respect to the body, thereby moving the sleeve a first axial distance within the body; and a cutter block at least partially disposed in the recess and movably coupled to the body, wherein the cutter block is arranged and designed to move at least the first axial distance with respect to the body in response to hydraulic pressure in the bore, and wherein the cutter block moves from a first outer diameter to a second outer diameter as the cutter block moves the first axial distance.

7. The underreamer of claim 6, wherein the threads formed on the outer surface of the sleeve comprise first and second portions, and wherein the first portion has a greater cross-sectional width than the second portion.

8. The underreamer of claim 7, wherein the first portion is adapted to deform when exposed to a first axial force, and the second portion is adapted to deform when exposed to a second axial force, and wherein the first axial force is less than the second axial force.

9. The underreamer of claim 8, wherein the first portion is made of a different material than the second portion.

10. The underreamer of claim 8, wherein the first portion has a void formed therein.

11. A method for increasing a diameter of a wellbore, comprising:

operating an actuator to rotate an annular sleeve coupled to the actuator, wherein the sleeve includes a set of threads formed on an outer surface thereof that is engaged with a set of threads formed in an inner surface of a body, the sleeve being moved a first axial distance within the body in response to the rotation of the sleeve; and applying hydraulic force to move a cutter block coupled to the body at least the first axial distance with respect to the body, wherein the cutter block moves radially outward from a first outer diameter to a second outer diameter as the cutter block moves the first axial distance, thereby increasing the diameter of the wellbore to the second outer diameter with the cutter block.

12. The method of claim 11, further comprising:

operating the actuator to move the sleeve a second axial distance within the body in response to the rotation of the sleeve; and applying hydraulic force to move the cutter block at least the second axial distance with respect to the body, wherein the cutter block moves radially outward from the second outer diameter to a third outer diameter as the cutter block moves the second axial distance, thereby increasing the diameter of the wellbore to the third outer diameter with the cutter block.

13. The method of claim 11, wherein the second outer diameter is determined by a number of times that the actuator rotates the sleeve.

14. The method of claim 11, wherein the actuator comprises an arm having a rod extending radially outward therefrom, and the sleeve comprises an axial groove formed in an inner surface thereof, and wherein an end portion of the rod is disposed within the groove.

15. The method of claim 14, further comprising transitioning the end portion of the rod through the groove as the sleeve moves the first axial distance with respect to the arm and the rod.

* * * * *